US008995901B2

(12) United States Patent
Michibata

(10) Patent No.: US 8,995,901 B2
(45) Date of Patent: Mar. 31, 2015

(54) IMAGE FORMING APPARATUS AND ROTATION CONTROL METHOD FOR MOTOR DRIVING ROTATION OF TIMING ROLLERS

(71) Applicant: Konica Minolta, Inc., Tokyo (JP)

(72) Inventor: Takumi Michibata, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 169 days.

(21) Appl. No.: 13/645,246

(22) Filed: Oct. 4, 2012

(65) Prior Publication Data

US 2013/0089364 A1 Apr. 11, 2013

(30) Foreign Application Priority Data

Oct. 6, 2011 (JP) ..... 2011-221918

(51) Int. Cl.
*G03G 15/00* (2006.01)
*B65H 9/14* (2006.01)
*G03G 15/01* (2006.01)

(52) U.S. Cl.
CPC ..... *G03G 15/0189* (2013.01); *G03G 15/6564* (2013.01); *G03G 2215/0132* (2013.01)
USPC ..... 399/394; 347/104

(58) Field of Classification Search
CPC ..... G03G 15/00; B65H 9/14
USPC ..... 399/388, 394, 396; 347/104
See application file for complete search history.

(56) References Cited

U.S. PATENT DOCUMENTS

2005/0196210 A1* 9/2005 Suzuki et al. ..... 399/388
2012/0007936 A9* 1/2012 Koyabu et al. ..... 347/215

FOREIGN PATENT DOCUMENTS

JP 07237789 A * 9/1995 ..... G03G 15/00
JP 10-324434 12/1998
JP 2002-274733 9/2002
JP 2005-247459 9/2005
JP 2006008293 A * 1/2006 ..... G03G 15/00
JP 2007-168976 7/2007
JP 2010-037087 2/2010
JP 2010-37103 2/2010

OTHER PUBLICATIONS

Decision to Grant a Patent mailed Oct. 22, 2013, directed to JP Application No. 2011-221918; 3 pages.

* cited by examiner

*Primary Examiner* — Nguyen Ha
(74) *Attorney, Agent, or Firm* — Lucas & Mercanti, LLP

(57) ABSTRACT

An image forming apparatus having a transport device including a pair of timing rollers, operable to cause a leading edge of a recording sheet to abut a nip portion of the non-rotating timing rollers, and then initiate rotation to transport the sheet toward a transfer position, the transport device comprising: a motor transmitting rotational force to the timing rollers via a power transmission mechanism such that the timing rollers rotate; and a control unit controlling motor rotation, wherein the control unit activates the motor, causes the timing rollers to transport a first recording sheet at a first speed, and stops the motor once transportation is complete, and when a second recording sheet is to be subsequently transported at a different second speed, the control unit causes the timing rollers to execute an idle rotation at the second speed or at another speed, and then stopping, before beginning second sheet transportation.

16 Claims, 12 Drawing Sheets

IMAGE FORMING APPARATUS AND ROTATION CONTROL METHOD FOR MOTOR DRIVING ROTATION OF TIMING ROLLERS

This application is based on application No. 2011-221918 filed in Japan, the contents of which are hereby incorporated by reference.

BACKGROUND OF THE INVENTION (1) Field of the Invention

The present invention pertains to a image forming apparatus such as a printer or copier, and specifically to technology for the transportation of a recording sheet by a pair of timing rollers.

(2) Description of the Related Art

In an image forming apparatus forming images through electrophotography, for example, the transportation of a recording sheet is temporarily stopped when a leading edge of the recording sheet abuts a nip portion formed in a pair of timing rollers, which are not rotating, in order to transfer a toner image formed on a photosensitive drum to the recording sheet at a correct position. The recording sheet is then transported by starting the rotation of the timing rollers with such timing that the leading edge of the toner image (including whitespace therein) formed on the photosensitive drum and the leading edge of the recording sheet meet at a transfer position. The toner image is then transferred to the recording sheet at the correct position.

The rotation drive source for the pair of timing rollers is frequently a motor that also drives the rotation of the photosensitive drum and other components. Rotational force is transmitted from the motor to the timing rollers via a power transmission mechanism. Also, the starting and stopping of rotation by the timing rollers is controlled by the motor, via a clutch provided immediately before the timing rollers in the power transmission mechanism that is switched ON and OFF.

In recent years, the system speed has been increased in order to improve the number of images formed per unit time, and the gap for transporting the recording sheet (i.e., the paper gap) has been made smaller. Thus controlling the starting and stopping of the rotation by the timing rollers by controlling the clutch has thus become difficult to execute while still having the timing rollers handle the recording sheet with precision.

Conventional technology having a common motor driving the photosensitive drum and the pair of timing rollers has progressed by providing a motor for the timing rollers that is separate from the motor for the photosensitive drum, and removing the clutch from the power transmission mechanism. In such a system, the start and stop of rotation by the timing rollers is controlled by switching the separate motor ON (activation) and OFF (stopping).

In such a configuration, a situation may arise where, after one set of image formation operations (hereinafter, a job), a job (hereinafter, later job) using a different system speed (i.e., the transport speed for the recording sheets) than the first job (hereinafter, earlier job) is executed. A relative discrepancy was then observed to arise in terms of image formation position between the first page and subsequent pages of the later job.

Upon research into the discrepancy, the inventor has identified backlash in the power transmission mechanism as the cause. The power transmission mechanism between the motor and the timing rollers is made up of a plurality of components, such as gears, for transmitting rotational force.

Each of these components has a degree of slack in the direction of rotation, or in other words, has backlash.

Thus, due to inertia, the components rotate within the range of the backlash after the motor is stopped. The rotation of the components caused by inertia after the motor is stopped is hereinafter termed momentum-driven rotation.

Accordingly, when the motor is restarted, the timing rollers begin to rotate only after the motor has rotated by an amount equivalent to the momentum-driven rotation. That is, a lag occurs between the activation of the motor and the beginning of rotation by the timing rollers, corresponding to the extent of the momentum-driven rotation (this lag is hereinafter termed rotation delay time).

The momentum-driven rotation is greater when the rotation speed of the motor is fast (i.e., when the transport speed for the recording sheets is fast), and is smaller when the rotation speed is slow (i.e., when the transport speed for the recording sheets is slow). Accordingly, the rotation delay is greater for jobs at a fast transport speed and is smaller for jobs at a slow transport speed.

As such, when, for example, an image formation job on a thick sheet at a slow transport speed is followed by an image formation job on a regular sheet at a fast transport speed, the image formation position for the first recording sheet of the later job is further upstream in the sheet transport direction than the image formation position for subsequent recording sheets.

In order to solve this problem, an approach has been devised that involves narrowing the range of tolerance for the component dimensions, so as to reduce the backlash for each component.

However, this approach reduces the yield rate of the components, and decreases manufacturability as a result of greatly reduced tolerances during assembly. Also, a certain degree of backlash between gears and the like is indispensible for the ensuring smooth rotation of engaged gears. Backlash can thus never be completely removed.

The above-discussed problem is not restricted to situations where a stop occurs at the conclusion of a job and the system speed (i.e., the transport speed for the recording sheets) is changed for a subsequent job. The problem also occurs when the transport speed for the recording sheets is changed during a single job.

SUMMARY OF THE INVENTION

In consideration of the above-described problem, the present invention seeks to effectively reduce the influence of backlash on the power transmission mechanism by providing a image forming apparatus capable of reducing image discrepancy as much as possible, and providing a rotation control method for the motor driving the rotation of the timing rollers.

In a first aspect of the present invention, an image forming apparatus having a transport device including a pair of timing rollers, operable to cause a leading edge of a recording sheet to abut a nip portion of the pair of timing rollers, which are not rotating, and to initiate rotation so as to transport the recording sheet toward a toner image transfer position, the transport device comprising: a motor transmitting rotational force to the pair of timing rollers via a power transmission mechanism such that the pair of timing rollers rotate; and a control unit controlling rotation by the motor, wherein the control unit activates the motor, causes the pair of timing rollers to transport a first recording sheet by rotating at a first rotation speed, and stops the motor once transportation is complete, and when a second recording sheet is to be subsequently transported at a second rotation speed that differs from the first rotation speed, the control unit causes the pair of timing rollers to execute an idle rotation operation of rotating at the second rotation speed, or at another speed closer to the second rotation speed than to the first rotation speed, and then stopping, before beginning transportation of the second recording sheet.

In a second aspect of the present invention, an image forming apparatus having a transport device including a pair of timing rollers operable to cause a leading edge of a recording sheet to abut a nip portion of the pair of timing rollers, which are not rotating, and to initiate rotation driving the pair of timing rollers to rotate at a first rotation speed or at a second rotation speed that differs from the first rotation speed, so as to transport the recording sheet toward a toner image transfer position, the transport device comprising: a motor transmitting rotational force to the pair of timing rollers via a power transmission mechanism such that the pair of timing rollers rotate; and a control unit controlling rotation by the motor, wherein the transport device defines transporting the recording sheet at the second rotation speed as a default, and when a final recording sheet of a given image formation job has been transported at the first rotation speed, upon concluding the first image formation job, the control unit causes the pair of timing rollers to execute an idle rotation operation of rotating at the second rotation speed and then stopping.

In a third aspect of the present invention, a rotation control method for a motor in an image forming apparatus operable to cause a leading edge of a recording sheet to abut a nip portion of a pair of timing rollers, which are not rotating, and to initiate rotation such that the pair of timing rollers rotate at a first rotation speed, or at a second rotation speed that differs from the first rotation speed, so as to transport the recording sheet toward a toner image transfer position, the motor causing the pair of timing rollers to rotate via a power transmission mechanism, the rotation control method comprising: a first step of activating the motor such that the pair of timing rollers rotate at the first rotation speed, causing the pair of timing rollers to transport a first recording sheet; a second step of stopping the motor once transportation of the first recording sheet is complete; a third step of activating the motor and causing the pair of timing rollers to execute an idle rotation operation at the second rotation speed, or at another speed that is closer to the second rotation speed than to the first rotation speed, and then stopping; and a fourth step of activating the motor such that the pair of timing rollers rotate at the second rotation speed, causing the pair of timing rollers to transport a second recording sheet.

In a fourth aspect of the present invention, a rotation control method for a motor in an image forming apparatus operable to cause a leading edge of a recording sheet to abut a nip portion of a pair of timing rollers, which are not rotating, and to initiate rotation such that the pair of timing rollers rotate at a first rotation speed or at a second rotation speed that is a default rotation speed, so as to transport the recording sheet toward a toner image transfer position, the motor causing the pair of timing rollers to rotate via a power transmission mechanism, the rotation control method comprising: a first step of activating the motor such that the pair of timing rollers rotate at the first rotation speed, causing the pair of timing rollers to transport a final recording sheet of a given image formation job; a second step of stopping the motor once transportation of the final recording sheet is complete; and a third step of, once the given image formation job is complete, activating the motor and causing the pair of timing rollers to execute an idle rotation at the second rotation speed, then stopping the motor.

BRIEF DESCRIPTION OF DRAWINGS

These and other objects, advantages, and features of the invention will become apparent from the following description thereof taken in conjunction with the accompanying drawings which illustrate a specific embodiment of the invention.

In the drawings.

DESCRIPTION OF PREFERRED EMBODIMENTS

An Embodiment of the image forming apparatus pertaining to the present invention is described below, with reference to the accompanying drawings.

(Overall Configuration of Image Forming Apparatus)

Figure 1:
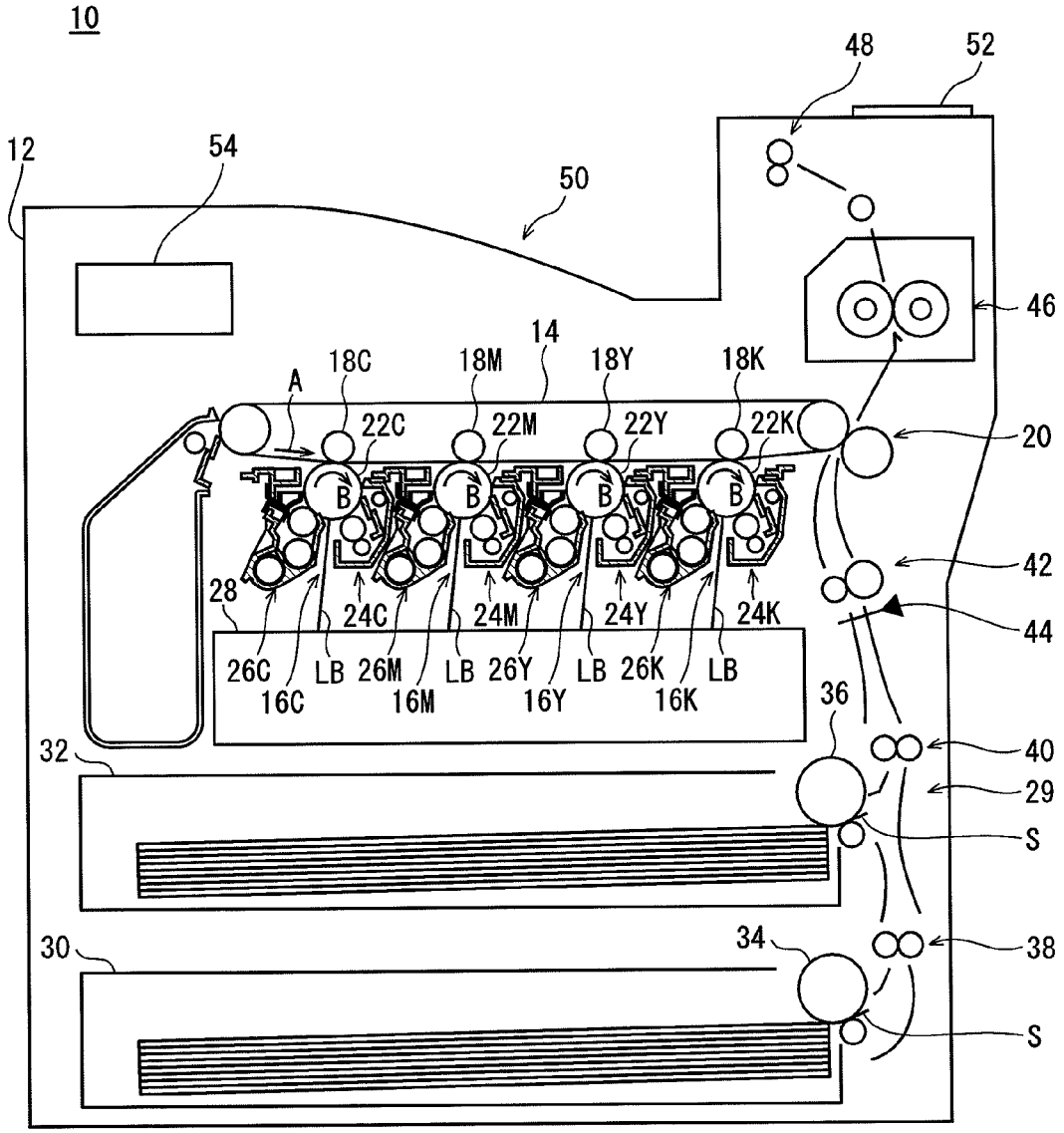
FIG. 1 is an overall configuration diagram of a tandem printer pertaining to an Embodiment.

FIG. 1 is an overall configuration diagram of a tandem printer 10 (hereinafter, printer 10) pertaining to the present Embodiment. Although this example describes a printer, the present invention is also applicable to another image forming apparatus, such as a copier or FAX machine.

As shown in FIG. 1, the printer 10 includes a transfer belt 14 suspended horizontally within a housing 12 and running in the direction indicated by arrow A, four imaging units 16C, 16M, 16Y, and 16K aligned in the running direction of the transfer belt 14, primary transfer rollers 18C, 18M, 18Y, and 18K provided in one-to-one correspondence with the imaging units, and a secondary transfer unit 20. The printer 10 is an intermediate-transfer image forming apparatus in which toner images created by the imaging units 16C, 16M, 16Y, 16K in one of each component colour are overlaid and temporarily transferred onto the transfer belt 14, then transferred onto a recording sheet S to form a colour image.

Each of the imaging units 16C, 16M, 16Y, and 16K includes a photosensitive drum 22C, 22M, 22Y, or 22K serving as an image carrier, as well as a charging unit 24C, 24M, 24Y, or 24K and a developing unit 26C, 26M, 26Y, or 26K disposed therearound. Also, an exposure unit 28 is disposed below the imaging units 16C, 16M, 16Y, and 16K, emitting a modulated laser LB toward the photosensitive drums 22C, 22M, 22Y, and 22K. The photosensitive drums 22C, 22M, 22Y, and 22K each rotate in the direction indicated by the respective arrows B. The surface of each photosensitive drum 22C, 22M, 22Y, and 22K is uniformly charged by the respective charging units 24C, 24M, 24Y, and 24K, then exposed to the laser LB so as to form a latent image. Each latent image is developed into a toner image by the respective developing units 26C, 26M, 26Y, and 26K. The developing units 26C, 26M, 26Y, and 26K supply toner, which is a developing agent, in a respective colour C (cyan), M (magenta), Y (yellow), or K (black) to the photosensitive drums 22C, 22M, 22Y, an 22K, in accordance with a modulation component of the laser.

The toner images formed on the photosensitive drums 22C, 22M, 22Y, and 22K are sequentially transferred onto the running transfer belt 14 through the effect of a magnetic field produced between the primary transfer rollers 18C, 18M, 18Y, and 18K and the photosensitive drums 22C, 22M, 22Y, and 22K.

Meanwhile, a recording sheet of a desired type and size is supplied by one of a first paper take-up cassette 30 and a second paper take-up cassette 32 in a recording sheet transport device 29 (hereinafter, a transport device 29).

The recording sheet S is delivered from the first paper take-up cassette 30 by a first pick-up roller 34. The recording sheet S so delivered is then transported to a pair of timing rollers 42 by a first vertical transport roller 38 and a second vertical transport roller 40. The recording sheet S is delivered from the second paper take-up cassette 32 by a second pick-up roller 36, then transported to the pair of timing roller 42 by the second vertical transport roller 40.

A leading edge of the recording sheet S so transported abuts a nip portion in the timing rollers 42, which are not rotating. Upon abutting, the recording sheet S is transported downstream in the transport direction, away from the timing rollers 42, for a predetermined time by rollers sandwiching the recording sheet S therebetween. As a result, the recording sheet S traces a loop. Accordingly, any skew in the transport direction of the recording sheet S is corrected.

Then, a later-described motor 64 for the timing rollers 42 is started, thus beginning the rotation of the timing rollers 42. The recording sheet S is transported to a transfer position in the secondary transfer unit 20 with timing such that the leading edge of the recording sheet S and the toner image (including whitespace therein) transferred onto the transfer belt 14 meet at the transfer position.

With respect to the pair of timing rollers 42, a sensor 44 provided directly upstream in the transport direction serves to detect the leading and trailing edges of the recording sheet S passing through a detection position while being transported along the transport path. The aforementioned skew correction occurs during a predetermined interval that begins when the sensor 44 detects the leading edge of the recording sheet S and involves the rotation of rollers sandwiching the recording sheet S during transport upstream by the timing rollers 42.

The secondary transfer unit 20 transfers the toner images overlaid on the transfer belt 14 to the recording sheet S. The toner images so transferred to the recording sheet S are then fixed by a fixing device 46. Once fixing is complete, exit rollers 48 cause the recording sheet S to exit onto an exit tray 50.

In the present Embodiment, the first paper take-up cassette 30 contains thick sheets, while the second paper take-up cassette 32 contains regular sheets. The regular sheets are, for example, recording sheets each having a weight ranging from 64 g/m$^2$ to 90 g/m$^2$. The thick sheets are recording sheets having more weight than the regular sheet and having a thickness that is greater than that of the regular sheets. The speed at which the recording sheet S is transported by the timing rollers 42 is a low transport speed LS when one of the thick sheets is used, and is a high transport speed HS when one of the regular sheets is used, the high transport speed HS being faster than the low transport speed LS. The speed at which the timing rollers 42 transport the recording sheet is none other than the system speed of the printer 10. Thus, the transport speed and the system speed are hereinafter defined as being identical. Accordingly, the low transport speed LS is also a low system speed LS, and the high transport speed HS is also a high system speed HS.

The printer 10 comprises an operation panel 52, disposed such that an upper face thereof is easily operated. The operation panel 52 includes a liquid crystal display unit, a menu selection key, cursor keys, a cancel key, and the like (none diagrammed). Operating the menu selection key and the cursor keys enables selection of a menu to be displayed on the liquid crystal display unit, and enables the execution of various settings. For example, these settings include setting the type and size of the recording sheets contained in the first paper take-up cassette 30 and the second paper take-up cassette 32.

The printer 10 further comprises a control unit 54. The control unit 54 controls the above-described units and devices in unison to execute smooth printing operations.

(Timing Rollers)

Figure 2:
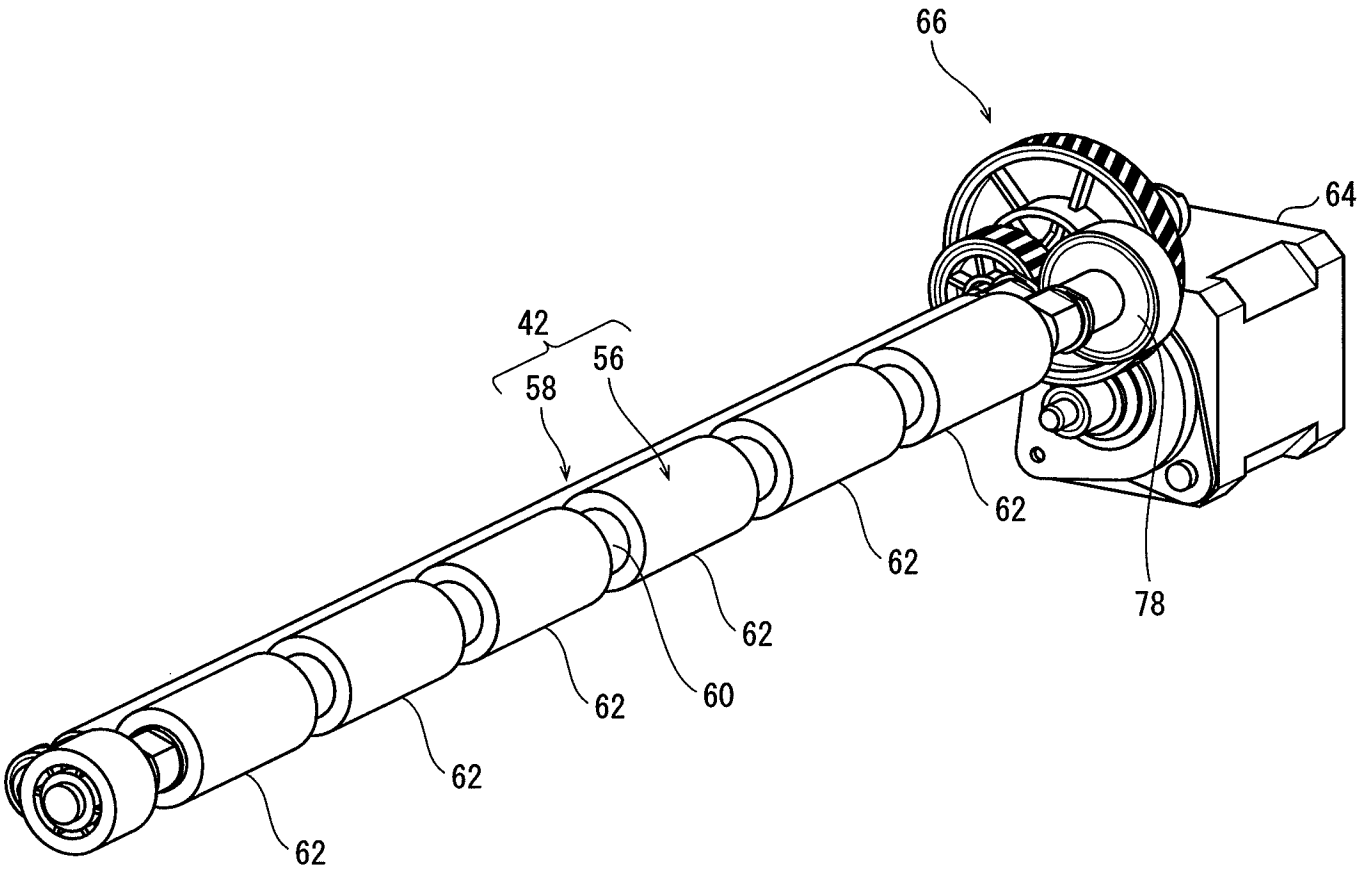
FIG. 2 is a perspective view diagram illustrating the overall configuration of a pair of timing rollers and a drive mechanism therefor.

FIG. 2 is a perspective view diagram illustrating the overall configuration of the pair of timing rollers 42 and a drive mechanism therefor.

The pair of timing rollers 42 is made up of a driving roller 56 and a driven roller 58, operating as a pair. The driving roller 56 has a core 60 made from an aluminium pipe having a plurality of rolls 62, each made of rubber, fitted thereover and separated from each other by gaps in the length direction. The driven roller 58 is radially pressed toward the driving roller 56 by a spring or similar resilient material (not diagrammed). Thus, a nip portion is formed at the point of contact between the driving roller 56 and the driven roller 58.

A spur gear 78 is attached to one end of the core 60.

The driving roller 56 in the pair of timing rollers 42 is driven to rotate by rotational force imparted thereto by the motor 64 via a power transmission mechanism that includes spur gear 78. In the present example, a stepping motor is used as the motor 64.

(Power Transmission Mechanism)

Figure 3:
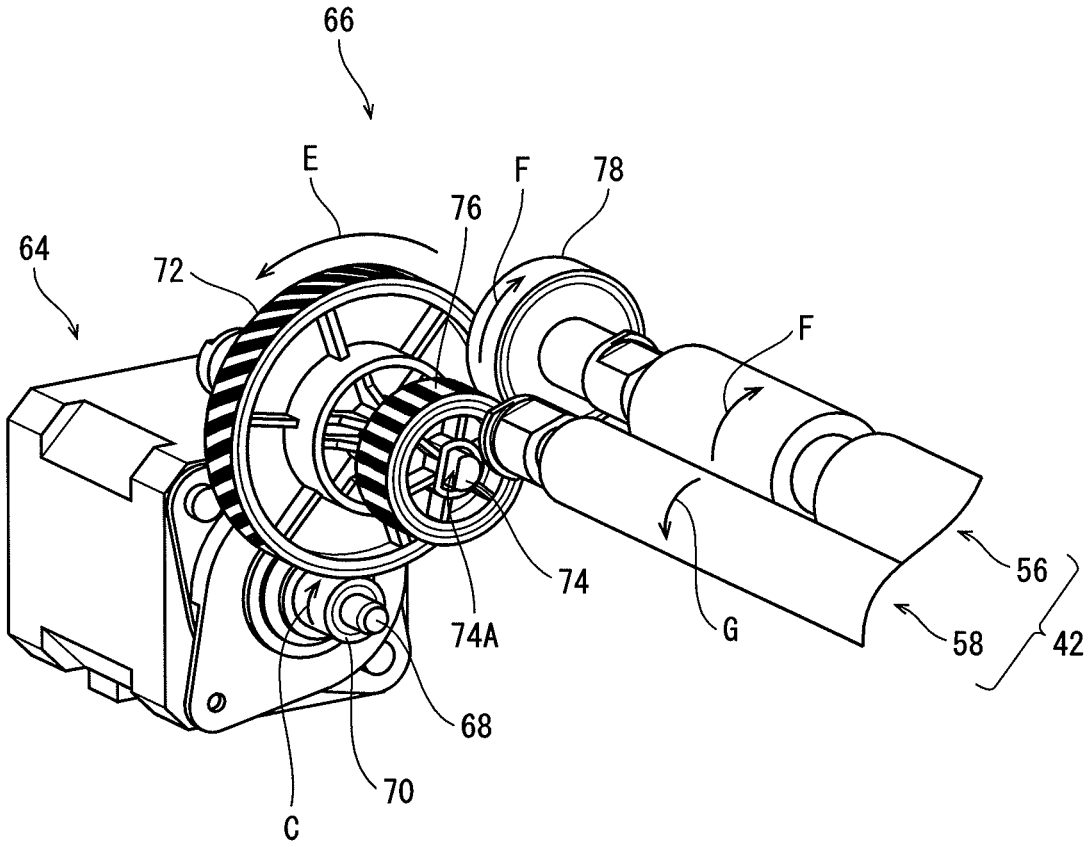
FIG. 3 is an expanded perspective view diagram illustrating a motor, a power transmission mechanism, and an end portion of the timing rollers.

FIG. 3 is an expanded perspective view diagram illustrating the motor 64, the power transmission mechanism 66, and end portions of the pair of timing rollers 42.

The motor 64 has an output shaft 68 with helical gear 70 attached thereto.

Helical gear 70 meshes with another helical gear 72, which has a larger radius.

An axial bore (not diagrammed in FIG. 3) is provided at the centre of helical gear 72, and has a shaft 74 inserted therein. The rotational force of helical gear 72 is transmitted to the shaft 74 by a later-described connection pin 86.

An end portion of the shaft 74 is cut at the circumference so as to have a D-shaped cross section, as described later (the end portion of the shaft 74 so cut is hereinafter referred to as a D-cut portion 74A).

Another spur gear 76 having a D-shaped axial bore is attached to the D-cut portion 74A of the shaft 74, by having the D-cut portion 74A be inserted into the axial bore.

Spur gear 78 meshes with spur gear 76 at the end portion of the driving roller 56.

In the power transmission mechanism 66, configured as described above, when the motor 64 is activated and causes the output shaft 68 to rotate in the direction indicated by arrow C, helical gear 70 is enjoined to also rotate in the direction of arrow C. As helical gear 70 rotates in the direction of arrow C, helical gear 72 engaged therewith rotates in the direction of arrow E.

Then, helical gear 72 enjoins the shaft 74, and subsequently, spur gear 76, to also rotate in the direction of arrow E. As spur gear 76 rotates in the direction of arrow E, spur gear 78 engaged therewith rotates in the direction of arrow F, and the driving roller 56 is enjoined to also rotate in the direction of arrow F. The driven roller 58, which is in contact with the driving roller 56, then rotates in the direction of arrow G.

According to the above sequence, the rotational force of the motor 64 is transmitted to drive the rotation of the timing rollers 42.

(Power Transmission Delay Due to Slack in Power Transmission Mechanism)

Delays to power transmission caused by slack in the direction of rotation at neigbouring components (any connecting components) of the power transmission sequence of the power transmission mechanism 66 are discussed below with reference to FIGS. 4, 5A through 5C, and 6A through 6E.

(i) Helical Gear 70 and Helical Gear 72

Figure 4:
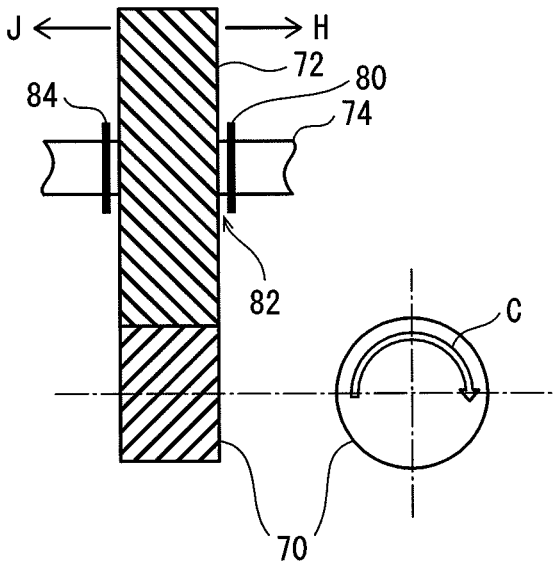
FIG. 4 illustrates helical gears as connecting components of the power transmission mechanism.

Slack between connecting components is further described below with reference to FIG. 4. Among these connecting components, the driver is helical gear 70, which rotates in the direction of arrow C, and helical gear 72 is driven thereby, receiving power from helical gear 70 in the axial direction. As described later, helical gear 72 loosely engages with the shaft 74 and thus displaced in the direction of arrow H upon receiving the force in the axial direction. A retaining ring 80 is attached to the shaft 74 and serves as a stopper preventing the separation of helical gear 72 and helical gear 70 and restricting the displacement of helical gear 72 during driving. Accordingly, a gap 82 formed in the axial direction between the two components in contact with the retaining ring 80 is eliminated on the side facing helical gear 72, during driving.

When the rotation of helical gear 70 stops, the rotation of helical gear 72 continues due to momentum. Upon rotating by an amount equivalent to the backlash between the two gears, a counterforce in the thrust direction is imparted to helical gear 72 by helical gear 70, causing displacement in the directions of arrow H and the opposing arrow J (this displacement is hereinafter termed momentum displacement). The momentum displacement increases with faster rotational speed of helical gear 72 prior to stopping the rotation (due to greater inertia). A retaining ring 84 is provided opposite retaining ring 80 in order to constrain the maximum momentum displacement.

Once the rotation of helical gear 70 is restarted, helical gear 72 begins to rotate and to be displaced in the direction of arrow H only after helical gear 70 has rotated by the amount equivalent to the backlash. Then, once helical gear 72 comes into contact with retaining ring 80, helical gear 72 begins to rotate normally in accordance with the reduction ratio.

That is, once helical gear 70 resumes rotation, helical gear 72 begins normal rotation only after displacement in the direction of arrow H corresponding to the momentum displacement. Accordingly, a lag corresponding to the momentum displacement occurs between the beginning of rotation by helical gear 70 and the beginning of normal rotation by helical gear 72. As described above, the momentum displacement depends on the speed of rotation prior to stopping. As a result, the faster the speed of rotation prior to stopping, the longer the lag, and conversely, the slower the speed, the shorter the lag.

(ii) Helical Gear 72 and Shaft 74

Slack between connecting components is further described below with reference to FIG. 5. Among the following components, the driver is helical gear 72 and the shaft 74 is driven thereby.

Figure 5A:
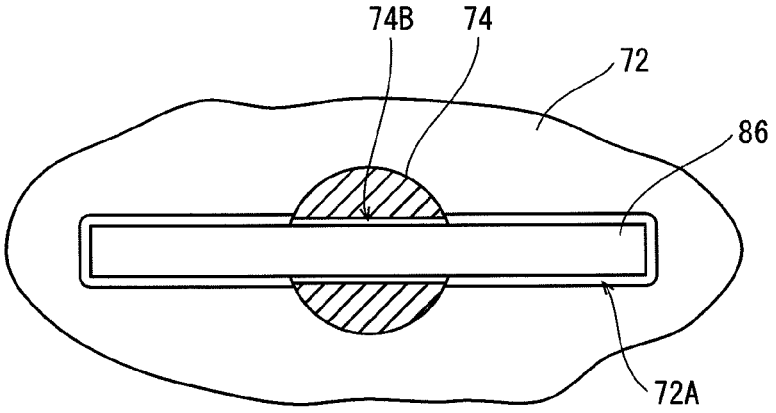
FIGS. 5A, 5B, and 5C each illustrate a pin connection in connecting components of the power transmission mechanism.

As shown in FIG. 5A, the shaft 74 has a hole 74B passing radially therethrough, and the connection pin 86 is loosely inserted in the hole 74B. A groove 72A is formed on one side of helical gear 72 so as to be elongated in the radial direction. An exposed portion of the connection pin 86 is implanted in the groove 72A. The clearance between the radius of the hole 74B and the connection pin 86 and the clearance between the connection pin 86 and the groove 72A is set as appropriate, in consideration of the assemblage connected thereto.

Figure 5B:
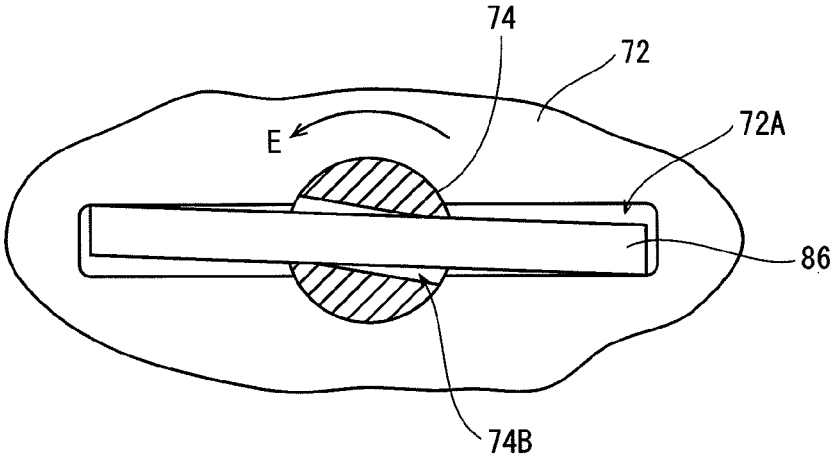

In the above configuration, as shown in FIG. 5B, the inner walls of the groove 72A and two corners of the connection pin 86 come into contact once helical gear 72 begins to rotate in the direction of arrow E, such that the connection pin 86 also rotates in the direction of arrow E. Once the connection pin 86 begins to rotate, the circumferential surface of the connection pin 86 comes into contact with the circumferential edge of the hole 74B in the shaft 74. Accordingly, the shaft 74 also rotates in the direction of arrow E.

Figure 5C:
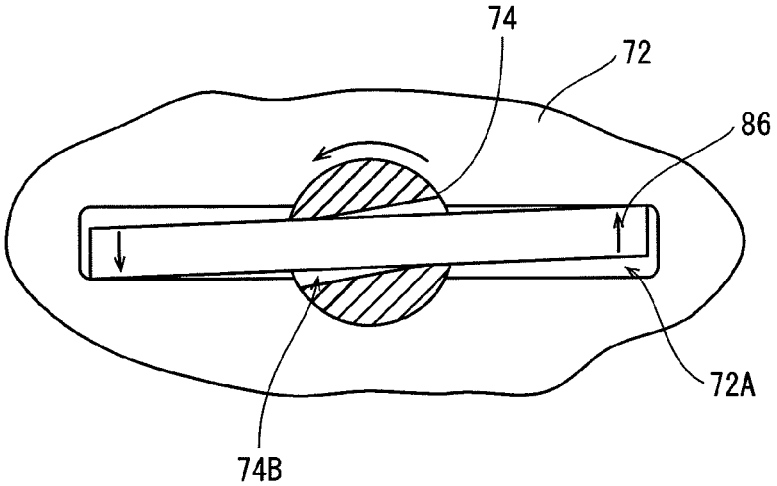

When the rotation of helical gear 72 stops, the rotation of the connection pin 86 and the shaft 74 continues due to momentum. The magnitude of this rotation due to momentum increases with faster rotational speed (due to increased inertia) of the connection pin 86 and the shaft 74, prior to stopping. FIG. 5C shows a state of maximum rotation.

When helical gear 72 resumes rotation, and after helical gear 72 has rotated by an amount corresponding to the magnitude of the above-described momentum-driven rotation, power is transmitted to the shaft 74, which begins to rotate.

Accordingly, a lag corresponding to the momentum-driven rotation occurs between the beginning of rotation by helical gear 72 and the beginning of normal rotation by the shaft 74. As described above, the magnitude of the momentum-driven rotation depends on the speed of rotation prior to stopping. As a result, the faster the speed of rotation prior to stopping, the longer the lag, and conversely, the slower the speed, the shorter the lag.

(iii) Shaft 74 and Spur Gear 76

Figure 6A:
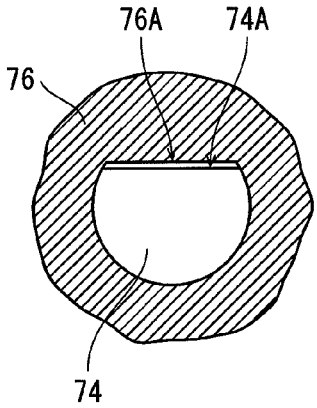
FIGS. 6A, 6B, and 6C each illustrate a spur gear and a shaft as connecting components in the power transmission mechanism.

Slack between connecting components is further described below with reference to FIGS. 6A, 6B, and 6C. Among the following components, the driver is the shaft 74 and spur gear 76 is driven thereby.

As described above and shown in FIG. 6A, spur gear 76 has a D-shaped axial bore 76A and the shaft 74 has the D-cut portion 74A. The D-cut portion 74A is inserted into the axial bore 76A so as to be able to transmit rotational force from spur gear 76 to the shaft 74.

Figure 6B:
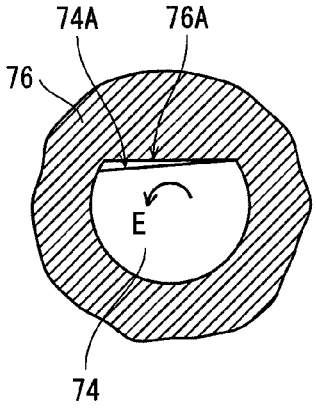
Figure 6C:
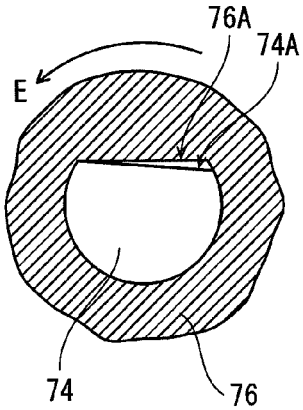

As shown in FIG. 6B, once the shaft 74 begins to rotate in the direction of arrow E, the right-hand edge portions of the respective D-cut faces come into contact. Power is thus transmitted to spur gear 76, causing spur gear 76 to rotate in the direction of arrow E.

When the rotation of the shaft 74 stops, the rotation of spur gear 76 continues due to momentum. The magnitude of this momentum-driven rotation increases with faster rotational speed (due to increased inertia) of spur gear 76, prior to stopping. FIG. 6C shows a state of maximum rotation.

Upon resuming rotation, the shaft 74 rotates by an amount corresponding to the magnitude of the above-described momentum-driven rotation. The rotation of spur gear 76 resumes only when the state illustrated in FIG. 6B is reached.

Accordingly, a lag corresponding to the momentum-driven rotation occurs between the beginning of rotation by the shaft 74 and the beginning of normal rotation by spur gear 76. As described above, the magnitude of the momentum-driven rotation depends on the speed of rotation prior to stopping. As a result, the faster the speed of rotation prior to stopping, the longer the lag, and conversely, the slower the speed, the shorter the lag.

(iv) Spur Gear 76 and Spur Gear 78

Slack between connecting components is further described below with reference to FIGS. 6D and 6E. Among these components, the driver is spur gear 76 and spur gear 78 is driven thereby. The slack between these components is in the form of backlash between spur gear teeth on each of the gears.

Figure 6D:
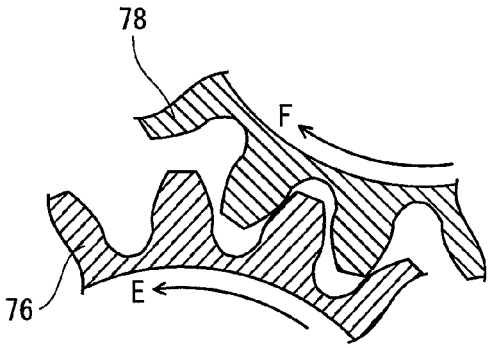
FIGS. 6D and 6E illustrate spur gears as connecting components in the power transmission mechanism.
Figure 6E:
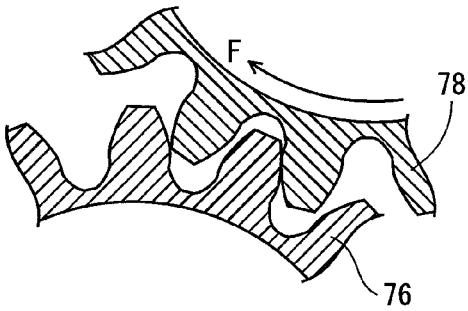

FIG. 6D illustrates a situation where spur gear 76 rotates, power is transmitted to spur gear 78 engaged therewith, and spur gear 78 rotates in the direction of arrow F.

When the rotation of spur gear 76 stops, the rotation of spur gear 78 continues due to momentum, within the backlash range. The magnitude of this momentum-driven rotation increases with faster rotational speed (due to increased inertia) of spur gear 78, prior to stopping. FIG. 6E shows a state of maximum rotation.

Upon resuming rotation, spur gear 76 rotates by an amount corresponding to the magnitude of the above-described momentum-driven rotation. The rotation of spur gear 78 resumes only when the state illustrated in FIG. 6D is reached.

Accordingly, a lag corresponding to the momentum-driven rotation occurs between the beginning of rotation by spur gear 76 and the beginning of normal rotation by spur gear 78. As described above, the magnitude of the momentum-driven rotation depends on the speed of rotation prior to stopping. As a result, the faster the speed of rotation prior to stopping, the longer the lag, and conversely, the slower the speed, the shorter the lag.

Although the above describes a lag occurring between the beginning of rotation by the driver and the beginning of rotation by the driven component for each set of connected components, the lag is also perceivable as a cumulative lag of the power transmission mechanism 66 as a whole. The cumulative lag is equivalent to the sum of the above-described lags, and occurs between the activation of the motor 64 (i.e., the beginning of rotation) and the beginning of rotation by the pair of timing rollers 42. Accordingly, the faster the rotational speed of the motor (and consequently, of the timing rollers) prior to stopping, the longer the lag between the next activation of the motor and the beginning of rotation by the timing rollers. Likewise, the slower the speed of the motor (and consequently, of the timing rollers) prior to stopping, the shorter the lag between the next activation of the motor and the beginning of rotation by the timing rollers.

The phenomenon of the lag between the activation of the motor 64 and the beginning of rotation by the timing rollers 42 is hereinafter termed rotation delay, and the lag itself is called a rotation delay time.

(Image Position Discrepancies)

When the speed at which the recording sheet is transported by the timing rollers (i.e., the rotation speed of the timing rollers) is changed, a mutual discrepancy, caused by the above-described rotation delay, arises between the toner image formed on the recording sheet immediately after the change and the formation of subsequent toner images on the recording sheet. The cause is further described below.

Figure 7:
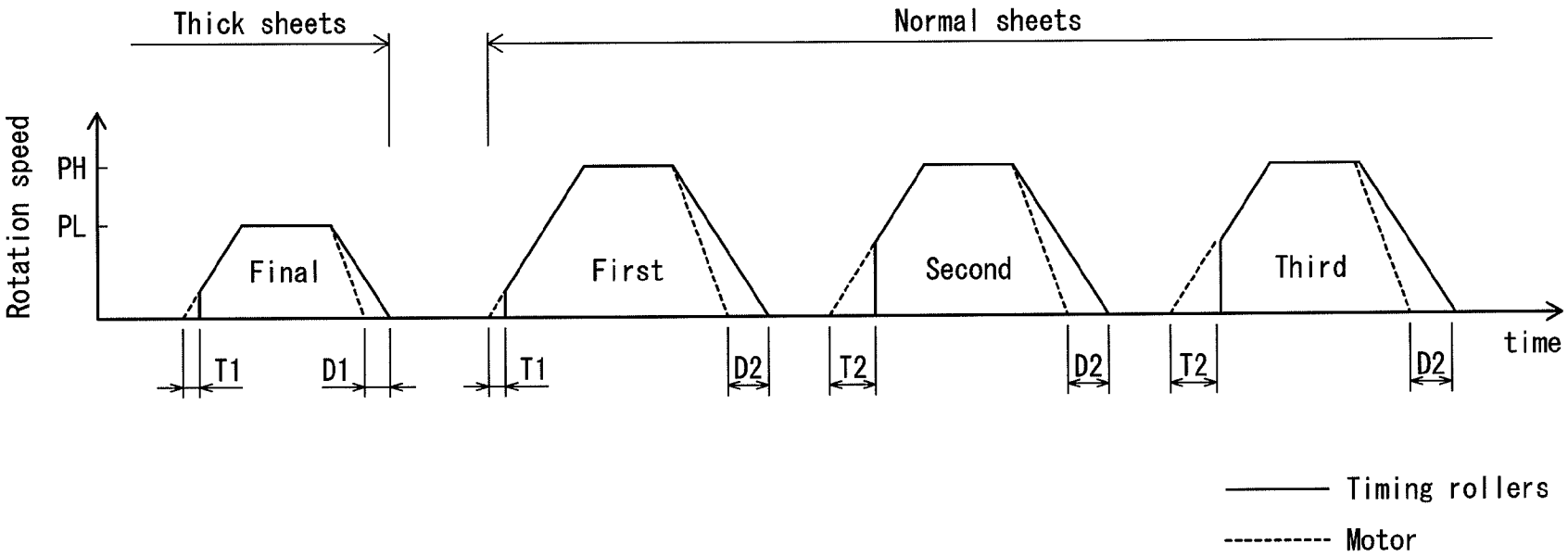
FIG. 7 illustrates the cause of relative image formation discrepancies between recording sheets.

FIG. 7 is a graph in which the horizontal axis represents time, the vertical axis represents rotation speed of the timing rollers (solid lines), and an operation diagram of the motor driving the timing rollers is superimposed (dashed lines) thereon. The vertical axis of the operation diagram is the aforementioned rotation speed of the motor. The vertical axis represents the rotation speeds of the pair of timing rollers and of the motor at different scales. Note that FIG. 7 is a schematic diagram provided in order to explain the aforementioned discrepancies, and is not an accurate representation of the rotation speeds.

FIG. 7 illustrates a case in which a thick sheet image formation job is followed by a regular sheet image formation job. The (steady) rotation speed of the timing rollers during image formation on a thick sheet is denoted PL, and the (steady) rotation speed of the timing rollers during image formation on a regular sheet is denoted PH (where PH>PL).

As indicated by the portion of the graph for the final thick sheet, the timing rollers begin to rotate after the rotation delay time T1 has elapsed since motor activation. Also, due to momentum, the timing rollers continue to rotate for time D1 after the motor is stopped.

For the first recording sheet of a regular sheet job executed after completing the thick sheet job, the rotation of the timing rollers begins after rotation delay time T1 has elapsed since the motor activation, in accordance with rotation speed PL. Conversely, once the motor is stopped, the timing rollers continue to rotate for a time (time D2) that is longer than time D1, proportional to the extent to which the rotation speed is greater than that used for the thick sheet (i.e., PH>PL).

Then, for the second regular sheet, the rotation of the timing rollers begins after rotation delay time T2 (where T2>T1) has elapsed since motor activation, in accordance with the rotation speed PH of the first sheet. Likewise, for the third sheet and subsequent sheets, the rotation of the timing rollers begins after rotation delay time T2 has elapsed since motor activation, in accordance with the rotation speed PH of the preceding (regular) recording sheet.

The time at which the recording sheet begins to be transported from the timing rollers to the transfer position for the toner image is measured beginning at the activation of the motor. Thus, the longer the rotation delay time, the later the recording sheet arrives at the transfer position. Thus, the toner image arrives at the transfer position relatively sooner. As a result, the toner image is formed on the recording sheet closer to the leading edge, with respect to the direction of transport.

Consideration of the first and second regular sheets reveals that the rotation delay time differs therebetween (such that T1<T2). The toner images formed (transferred) on the first and second regular sheets differ in that the image formed on the second sheet is closer to the leading edge than that formed on the first sheet. Thus, a relative discrepancy arises between sheets. No such discrepancy exists between the second sheet and subsequent recording sheets, given that the rotation delay time remains constant (i.e., is T2).

Although omitted from the drawings, the opposite case, i.e., a case where an image formation job on thick sheets follows an image formation job on regular sheets, may also occur. In such a case, respective images are formed closer to the trailing edges the second and subsequent thick sheets than to the trailing edge of the first thick sheet, such that a relative discrepancy arises between the first sheet and the subsequent sheets.

In response to the above described problem, the present Embodiment has the timing rollers execute an idle rotation operation when the transport speed for the recording sheet is changed, such that the timing rollers stop and perform an idle rotation at the post-change rotation speed before beginning the transportation of the recording sheet at the post-change rotation speed.

With reference to FIG. 7, the timing rollers are made to rotate at rotation speed PH and then stop between the final thick sheet and the first regular sheet. Accordingly, the rotation delay time for the first regular sheet is time T2, thus matching the rotation delay time for the second and subsequent sheets. As such, the above-described image formation discrepancy is constrained as much as possible.

(Control Unit)

The control unit 54 executing the above-described controls, including the idle rotation, is described below with reference to FIG. 8.

Figure 8:
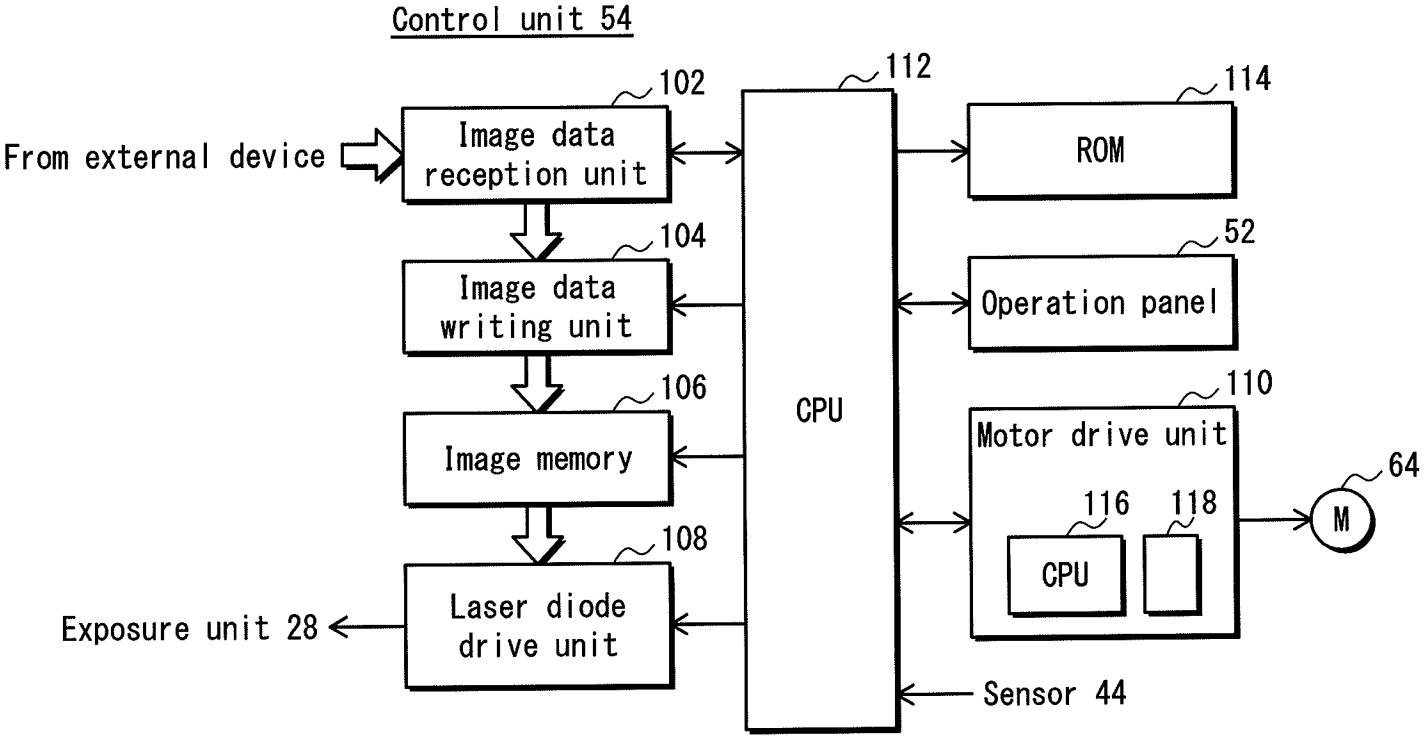
FIG. 8 is a block diagram indicating the overall configuration of a control unit for a printer.

FIG. 8 is a block diagram indicating the overall configuration of the control unit 54.

As indicated, the control unit 54 includes an image data reception unit 102, an image data writing unit 104, an image memory 106, a laser diode drive unit 108, a motor drive unit 110, CPU 112, and ROM 114.

In accordance with an instruction from CPU 112, the image data reception unit 102 applies various correction processes, such as edge enhancement, to image data in an image formation job received from a personal computer or the like, then transmits the image data to the image data writing unit 104.

In accordance with the instruction from CPU 112, the image data writing unit 104 writes the image data transmitted thereto by the image data reception unit 102 to the image memory 106.

In accordance with the instruction from CPU 112, the laser diode drive unit 108 reads the image data from the image memory 106 and according to the data so read, drives the modulation of (non-diagrammed) laser diodes provided for each colour C, M, Y, and K with respect to the exposure unit 28.

The motor drive unit 110 controls the activation, stopping, and rotation speed of the motor 64. The motor drive unit 110 has CPU 116 and executes control upon receiving instructions from the CPU 112. The motor drive unit 110 also includes a speed setting storage unit 118 storing the transport speed (i.e., the system speed) for recording sheets recently transported by the timing rollers 42.

(Motor Drive Control)

Next, the rotation control executed by the motor drive unit 110 on the motor 64 is described with reference to FIGS. 9 and 10.

Figure 9:
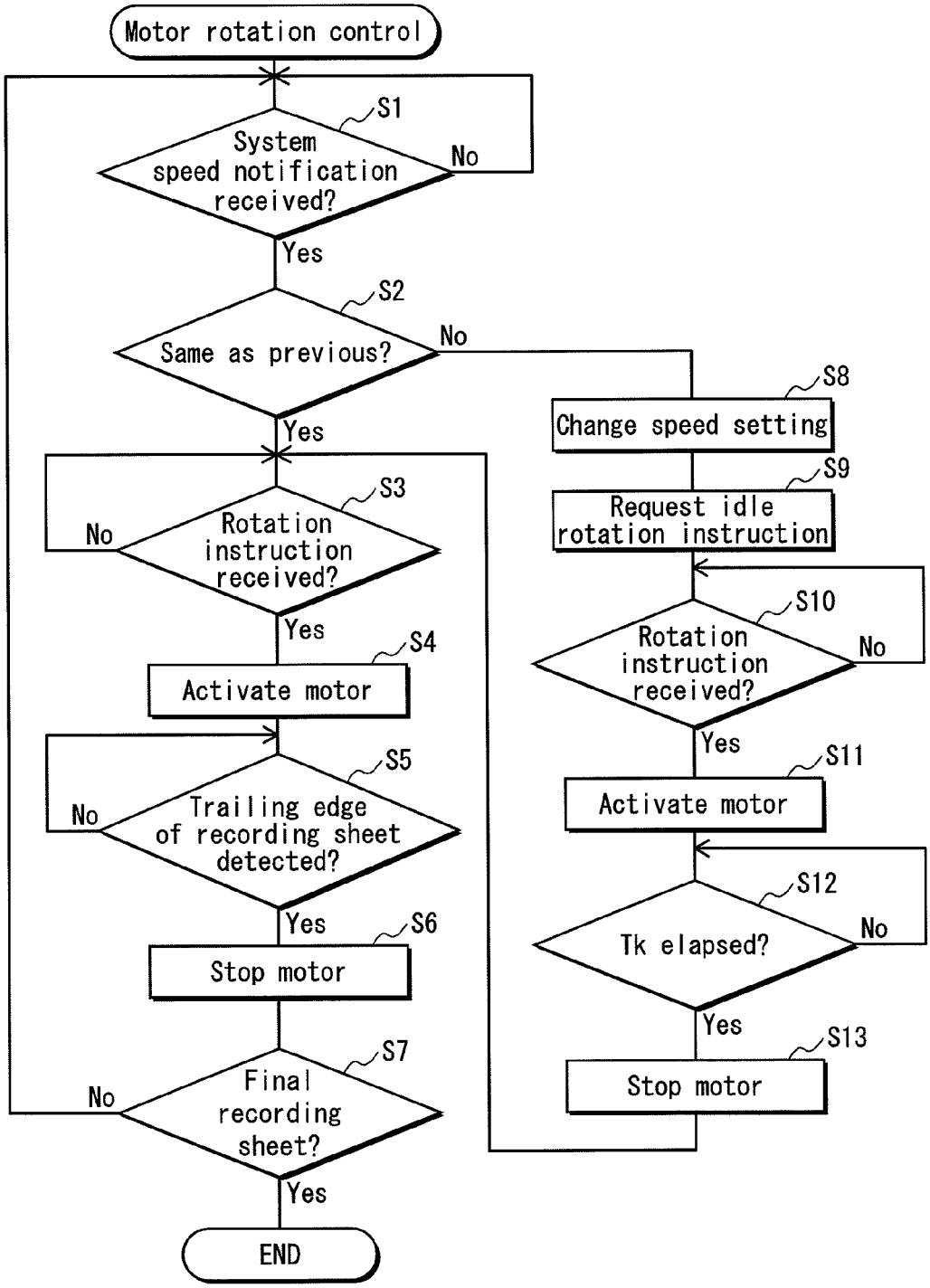
FIG. 9 is a flowchart of a program executed by a CPU of a motor drive unit of the control unit.
Figure 10:
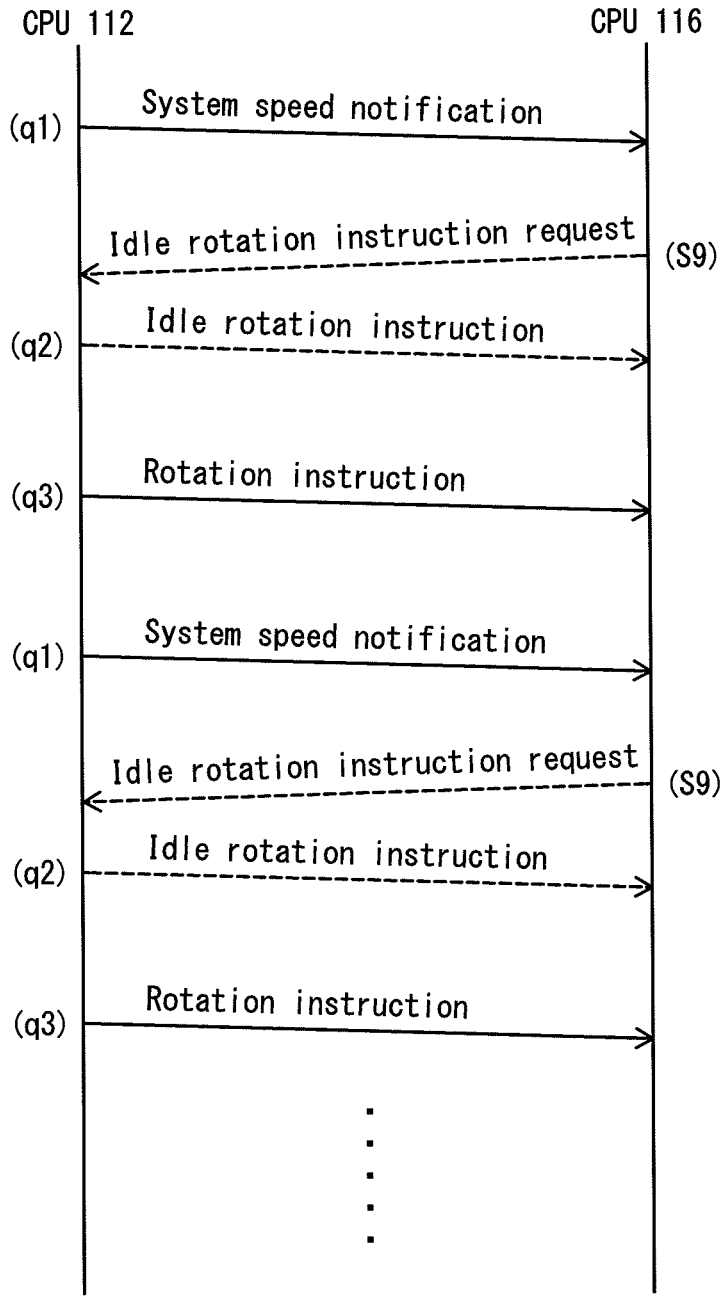
FIG. 10 is a sequence diagram illustrating communication between two CPUs in the control unit.

FIG. 9 is a flowchart of a motor rotation control program executed by CPU 116 (see FIG. 8) of the motor drive unit 110. FIG. 10 is a sequence diagram representing exchanges between CPU 116 and CPU 112 during program execution. In the sequence diagram, the CPU 116 side is labeled with step numbers corresponding to the flowchart.

The program under discussion is activated by an instruction from CPU 112 upon reception of a new image formation job. As the following explanation clarifies, when the program is activated, the speed setting storage unit 118 stores the transport speed for the last recording sheet of the most recent previously-completed image formation job.

For the image formation job received by the image data reception unit 102, CPU 112 reads header information for each page, determines a system speed (i.e., the transport speed) for the next page (i.e., recording sheet) using the header information, and notifies CPU 116 of the system speed (i.e., the transport speed) so determined (q1). Specifically, the header information includes information specifying whether the recording sheet to be used for printing the page is a regular sheet or a thick sheet. The determination results in using the high system speed HS (i.e., the high transport speed HS) when a regular sheet is to be used, and using the low system speed (i.e., low transport speed LS) when a thick sheet is to be used.

When a particular page (i.e., recording sheet) is the last page (i.e., the final recording sheet) of a given image formation job, the header information also includes information to such effect. For the final recording sheet, CPU 112 notifies CPU 116 that the recording sheet is final, along with the system speed (i.e., the transport speed) therefor.

Upon receiving such a notification (Yes in step S1), CPU 116 compares the system speed (i.e., the transport speed) so received and the transport speed in the speed setting storage unit 118 (step S2). If the two are identical (Yes in step S2), CPU 116 waits for a motor 64 rotation instruction (q3) from CPU 112 (step S3).

CPU 112 issues a motor 64 rotation instruction to CPU 116 which such timing that the leading edge of the recording sheet abutting the nip portion of the timing rollers 42, which are not currently rotating, matches the leading edge of the toner image (including whitespace therein) formed on the transfer belt 14, which is currently rotating, at the transfer position in the secondary transfer unit 20 (q3). Upon receiving the instruction (Yes in step S3), CPU 116 activates the motor 64 (step S4), causing the motor 64 to rotate at a rotation speed corresponding to the transport speed stored in the speed setting storage unit 118.

Accordingly, the recording sheet begins to be transported by the timing rollers 42.

Once the trailing edge, with respect to the transport direction, of the transported recording sheet is deemed to have passed through the timing rollers 42 (Yes in step S5), the transport of the recording sheet by the timing rollers is deemed complete. CPU 116 then stops the motor 64 (step S6). In step S5, the trailing edge of the recording sheet is deemed to have passed through the timing rollers 42 once a predetermined interval elapses after the sensor 44 (see FIG. 1) detects the trailing edge. The predetermined interval is the time needed for the trailing edge to move from the detection position of the sensor 44 to the nip portion of the timing rollers 42. This time is calculated from the transport speed and the distance between the detection position of the sensor 44 and the nip portion of the timing rollers 42, and is stored in the ROM 114 (see FIG. 8) in advance.

If CPU 116 has received a final recording sheet notification from CPU 112 during step S1 (Yes in step S7), the program is ended. If no such notification has been received (No in step S7), CPU 116 waits for a notification from CPU 112 of the system speed (i.e., the transport speed) from the next page (i.e., recording sheet) on which to perform image formation (step S1).

Also, if the result of step S2 is that the received system speed (i.e., the transport speed) and the transport speed stored in the speed setting storage unit 118 are different (No in step S2), CPU 116 changes the transport speed stored in the speed setting storage unit 118 to the received transport speed (step S8), and makes an idle rotation instruction request to CPU 112 (step S9).

Upon receiving the idle rotation instruction request, CPU 112 makes an idle rotation instruction (q2) to CPU 116, timed such that the idle rotation is completed before the leading edge of the recording sheet supplied by the first paper take-up cassette 30 or by the second paper take-up cassette 32 arrives at the nip portion of the timing rollers 42. Upon receiving the idle rotation instruction (q2) from CPU 112 (Yes in step S10), CPU 116 activates the motor 64 (step S11) and causes the motor 64 to rotate at a speed corresponding to the transport speed stored in the speed setting memory unit 118. CPU 116 stops the motor 64 once predetermined time Tk has elapsed since activation (Yes in step S12). Predetermined time Tk is beneficially set to the minimum value needed for ordinary rotation of the timing rollers 42 at the speed corresponding to the transport speed stored in the speed setting memory unit 118.

The process then advances to step S3. CPU 116 waits for a motor 64 rotation instruction (q3) from CPU 112, intended for starting the transportation of the recording sheet by the timing rollers 42.

Then, the above-described process is repeated until the transportation of the final recording sheet is completed (Yes in step S7).

(Specific Example of Motor Driving)

A specific example of driving the motor 64 by executing the above-described control is given below, with reference to FIGS. 11A through 11D.

FIGS. 11A through 11D are line drawings each showing the operations of the motor 64, with the horizontal axes representing time and the vertical axes representing the rotation speed (rotations per unit time) of the motor 64. The label RL on the vertical axes indicates the rotation speed used for image formation on a thick sheet, when the timing rollers 42 rotate at rotation speed PL. Similarly, the label RH indicates the rotation speed used for image formation on a regular sheet, when the timing rollers 42 rotate at rotation speed PH. Needless to say, the values of RL and RH are such that RH>RL.

The following example is illustrated by FIGS. 11A through 11D and is described by correspondence to the flowchart of FIG. 9.

Figure 11A:
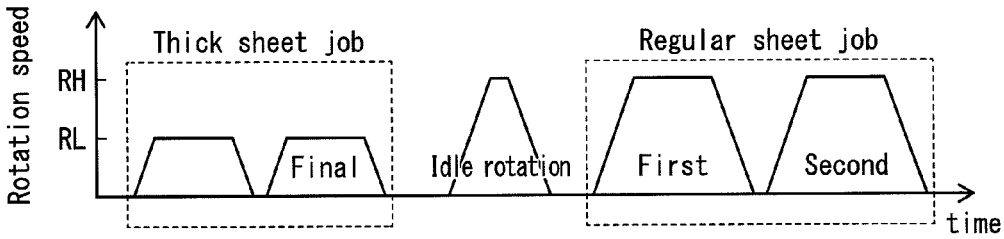
FIGS. 11A, 11B, 11C, and 11D illustrate specific examples of motor drive control executed by the motor drive unit.

In FIG. 11A, an image formation job on a thick sheet (hereinafter, a thick sheet job) is followed by an image formation job on a regular sheet (hereinafter, a regular sheet job).

When the transport of the final recording sheet of the thick sheet job is complete, the low transport speed LS is stored in the speed setting memory unit 118 (see FIG. 8). For the first page of the regular sheet job, CPU 112 notifies CPU 116 of the high transport speed HS (i.e., the high system speed HS). The transport speed in the notification differs from the previously-used (for the final recording sheet of the thick sheet job) transport speed (i.e., the transport speed stored in the speed setting memory unit 118) (No in step S2). Thus, before transportation begins for the first recording sheet of the regular sheet job (step 4), the timing rollers 42 execute idle rotation at the transport speed for the regular sheets (i.e., the high transport speed HS) (steps S11-S13).

Accordingly, the rotation delay time for the first page of the regular sheet job is T2 (see FIG. 7). The transport speed does not change for the second and subsequent sheets of the regular sheet job. Thus, the rotation delay time therefor is also T2 (see FIG. 7). This has the effect of constraining the possibility of a relative discrepancy arising, with respect to the transport direction, between the first page and subsequent pages of the regular sheet job, in terms of the formation (i.e., the transfer) of the toner image on the recording sheet.

Thus, according to the present Embodiment, the possibility of a relative discrepancy arising between the first page and subsequent pages of later regular sheet jobs is constrained, despite the difference in system speed (i.e., in the speed at which the timing rollers 42 transport the recording sheet) between successive image formation jobs.

Figure 11B:
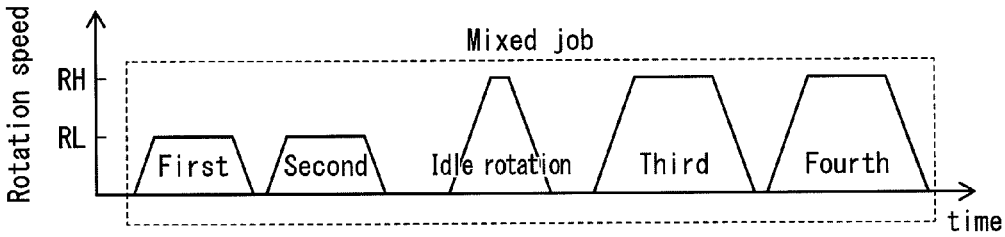

FIG. 11B indicates an image formation job in which some images are formed on thick sheets and other images are formed on regular sheets (hereinafter, a mixed job). In this example, the first and second sheets are thick sheets, while the third and fourth sheets are regular sheets.

Once the transportation of the second recording sheet (a thick sheet) is complete, the low transport speed LS is stored in the speed setting memory unit 118 (FIG. 8). For the third sheet, CPU 112 notifies CPU 116 of the high transport speed HS (i.e., the high system speed HS). The transport speed in the notification differs from the previously-used (for the thick sheet of the second page) transport speed (i.e., the transport speed stored in the speed setting memory unit 118) (No in step S2). Thus, before transportation begins for the regular sheet third sheet (step 4), the timing rollers 42 execute idle rotation at the transport speed for the regular sheets (i.e., the high transport speed HS) (steps S11-S13).

Accordingly, the rotation delay time for the third page is T2 (see FIG. 7). The transport speed does not change for the fourth sheet. As such, the rotation delay time therefor is also T2 (see FIG. 7). This has the effect of constraining the possibility of a relative discrepancy arising, with respect to the transport direction, between the third and fourth page, in terms of the formation (i.e., the transfer) of the toner image on the recording sheet.

As such, according to the present Embodiment, the possibility of a relative discrepancy arising between the first page and subsequent pages of later regular sheet jobs is constrained when the system speed (i.e., the speed at which the recording sheet is transported by the timing rollers 42) is changed during a mixed job.

Figure 11C:
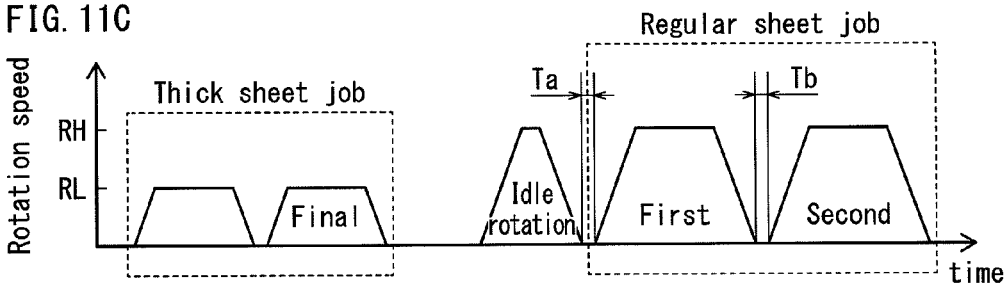

FIG. 11C shows an example like that of FIG. 11A, differing in that time Ta, from the end of the idle rotation of the motor 64 to the activation of the motor 64 for the transport the first recording sheet, is equal to time Tb, from the end of the transportation of a given recording sheet by the motor 64 to the activation of the motor 64 for the transport of the next recording sheet.

When Ta is significantly longer than Tb, the members of the connecting components in the power transmission mechanism are prone to rotation during time Ta, caused for example by vibrations within the housing 12, despite the motion of the connecting components being stopped after completing the idle rotation. Consequently, a situation may arise in which the state of the connecting components in the power transmission mechanism at motor 64 activation time for the transportation of the first recording sheet differs from the state of the connecting components in the power transmission mechanism at motor 64 activation time for the transportation of the second recording sheet.

However, the above-described approach allows matching of the state of the connecting components in the power transmission mechanism when the motor 64 is activated for the transport of the first recording sheet (in terms of momentum-driven rotation and so on) and the state of the connecting components in the power transmission mechanism when the motor 64 is activated for the transport of the second recording sheet (in terms of momentum-driven rotation and so on). Thus, the rotation delay time for the first and second recording sheets can be equalized. As a result, the relative discrepancy between the first sheet and subsequent sheets is further constrained.

Ta and Tb are equalized by having CPU 112 and CPU 116 cooperate to plan the timing of each instance where the motor is stopped (step S13, step S6) and started (step S4), such that the time (Ta) between one instance where the motor is stopped (step S13) and started (step S4) is equal to the time (Tb) between another instance where the motor is stopped (step S5) and started (step S4).

(Variations)

Figure 11D:
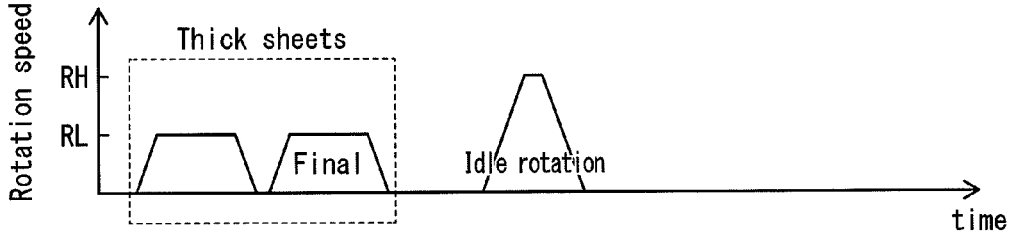

FIG. 11D is a line diagram of operations pertaining to rotation control executed in a variation.

The present variation describes a situation in which preparations are made for using a regular sheet as the recording sheet. In other words, the high transport speed HS is being set up as the transport speed for the recording sheet. This preparation is predicated on the regular sheets being more frequently used than the thick sheets.

Once the above-described settings are in place, the timing rollers 42 perform an idle rotation at rotation speed PH after the final recording sheet has been transported whenever the final recording sheet is a thick sheet.

Accordingly, when the next job is executed using regular sheets some time after the thick sheet is used, there is no need to perform a further idle rotation. The transportation of the first recording sheet by the timing rollers 42 can begin sooner, as the image formation time (FCOT or FPOT) corresponding thereto is not needlessly extended.

A program for executing the above-described control is described with reference to the flowchart of FIG. 12.

Figure 12:
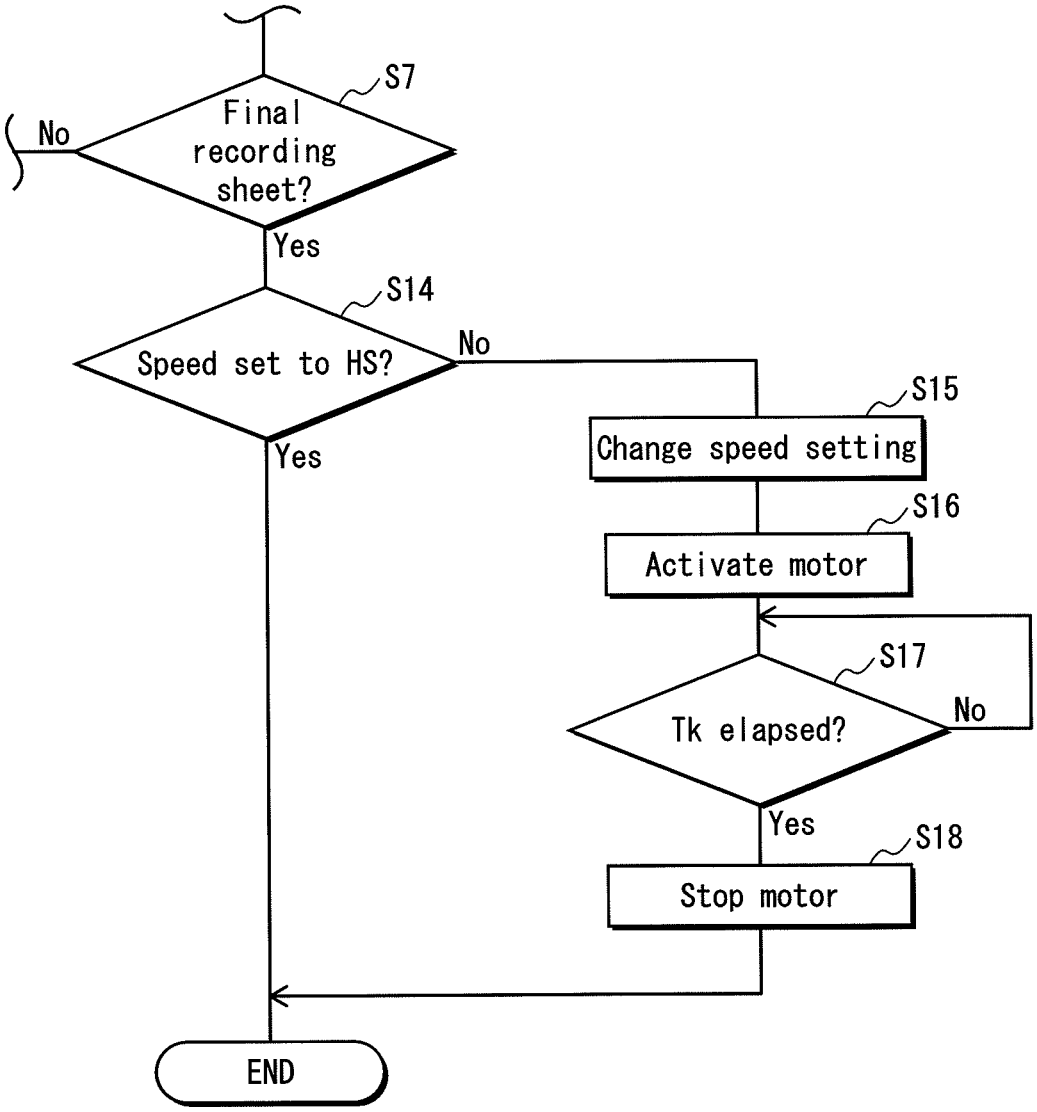
FIG. 12 is a flowchart of a variant program executed by a CPU of a motor drive unit of the control unit.

FIG. 12 is a flowchart of a program pertaining to the present variation. The steps described by FIG. 12 are executed after step S7 of the flowchart from FIG. 9. That is, the program pertaining to the present variation is made up of steps S1 through S13 from FIG. 9 and steps S14 through S18 from FIG. 12.

When CPU 116 has received a notification from CPU 112 during step S1 concerning the final recording sheet (Yes in step S7), CPU 116 makes a determination as to whether or not the high transport speed HS is stored in the speed setting storage unit 118 (step S14).

When the high transport speed HS is so stored (Yes in step S14), the program ends.

Conversely, when the low transport speed LS is stored (No in step S14), the speed setting stored in the speed setting storage unit 118 is rewritten with the high transport speed HS (step S15). Afterward, the timing rollers 42 perform an idle rotation at the high rotation speed PH (steps S16, S17, S18). The program then ends. The process of steps S16 through S18 is identical to that of steps S11 through S13 from FIG. 9. The details thereof are thus omitted.

When the program has ended and the next job uses regular sheets (regardless of whether the final recording sheet of the preceding job was a thick sheet), the idle rotation is not repeated before the transportation of the first recording sheet for the next job begins (Yes in step S2 (see FIG. 9)). Thus, the image formation time (FCOT or FPOT) for the first recording sheet is not needlessly extended.

When the thick sheets are used more frequently than the regular sheets, the inverse of the above applies, such that the thick sheets are considered to be the default recording sheets. For such cases, the determination made in step S14 (FIG. 12) concerns whether or not the low transport speed LS is stored in the speed setting storage unit 118. Then, when the high transport speed HS is stored (No in step S14), the speed setting stored in the speed setting storage unit 118 is rewritten with the standard low transport speed LS (step S15). Afterward, the timing rollers 42 execute an idle rotation at the low rotation speed PL (steps S16, S17, S18). The program then ends.

Most importantly, when the thick sheets are established as the default recording sheets, then when the final recording sheet of a job is a regular sheet, an idle rotation at the low rotation speed PL is not necessarily required at the conclusion of the regular sheet job.

When image formation on a thick sheet follows image formation on a regular sheet, the fixing temperature of the fixing device 46 is raised higher than that used for a regular sheet. The idle rotation at the low rotation speed PL can be executed concurrently with this temperature rise. As such, there is little need for an idle rotation to be performed ahead of time.

The program for the above-described variation includes steps S1 through S13 from FIG. 9 and steps S14 through S18 from FIG. 12, and the control unit 54 has been described as executing steps S1 through S18. However, no limitation is intended. The control unit 54 may also execute only the steps corresponding to the indications given by FIG. 12.

That is, when the regular sheets are established as the default recording sheets to be used, i.e., when the default speed at which the recording sheets are transported is set to the high transport speed HS, and the final recording sheet of a given job is a thick sheet (i.e., when the speed at which the final recording sheet is transported is the low transport speed LS), then the timing rollers 42 perform an idle rotation at the rotation speed PH once the transportation of the final recording sheet is complete (i.e., the timing rollers 42 perform an idle rotation at rotation speed PH when the given job ends).

The merits of this approach are the same as those of the above-described variation.

Although the present invention is described above with reference to the Embodiment, no limitation thereto is intended. For example, the following variations are also possible.

(1) In the above-described Embodiment, two paper take-up cassettes are provided, thick sheets and regular sheets are used as the recording sheets, and the recording sheets are transported at two speeds. However, no limitation is intended. Three or more paper take-up cassettes may be provided, the varieties of recording sheets may be increased in number, and the recording sheets may be transported at three or more different speeds.

In such circumstances, when the transport speed for the recording sheets (i.e., the rotation speed for the timing rollers) is changed, the timing rollers perform an idle rotation at the post-change rotation speed, prior to beginning the transportation of the first recording sheet after the change. This control can be executed by the program of the flowchart from FIG. 9.

(2) In the above-described Embodiment, the transport speed for the recording sheets (i.e., the system speed) is changed according to the type of recording sheet being used. However, no limitation is intended. The transport speed for the recording sheets (i.e., the system speed) may also be changed according to whether a monochrome image or a colour image is being formed. In such circumstances, the transport speed for the recording sheets (i.e., the system speed) used for colour image formation is slower than that used for monochrome image formation.

(3) In the above-described Embodiment, whenever the system speed (the transport speed for the recording sheets) is changed, the timing rollers 42 perform an idle rotation at a system speed corresponding to the post-change system speed before beginning the transportation of the recording sheet at the post-change system speed. In other words, the motor 64 is activated, causes the timing rollers 42 to rotate at a first speed, completes the transportation of a first recording sheet, then is stopped. Subsequently, when a second recording sheet is transported at a second rotation speed that differs from the first rotation speed, the timing rollers 42 perform an idle rotation at the second rotation speed before beginning the transportation of the second recording sheet.

However, the rotation speed of the timing rollers 42 for the idle rotation is not limited to the second rotation speed. Any speed that is closer to the second rotation speed than the first rotation speed may be used.

Accordingly, the state of the connecting components in the power transmission mechanism 66 when the motor 64 is activated to transport the second recording sheet (e.g., the momentum-driven rotation) is more similar to the state of the connecting components in the power transmission mechanism 66 when the motor 64 is activated to transport subsequent recording sheets, relative to a case where no idle rotation occurs. Thus, the rotation delay time before the transportation of the second recording sheet is made more similar to the rotation delay time before the transportation of the subsequent recording sheet than is the case in the absence of the idle rotation. As a result, the relative discrepancy between the images formed on the second recording sheet and on the next recording sheet can be made smaller than is the case in the absence of the idle rotation.

(4) The above Embodiment is described as a printer. However, for a copier, the image data reception unit (see FIG. 8) may receive an image formation job from an image reading device (i.e., a scanner). Also, the type of recording sheet (e.g., thick sheet or regular sheet) is specified via the operation panel, and the transport speed for the recording sheet (i.e., the system speed) is set in accordance with the type of recording sheet so specified.

The transport speed for the recording sheet (i.e., the system speed) may also be determined in accordance with an instruction made via the operation panel specifying a monochrome copy or a colour copy.

(5) The above Embodiment describes a stepping motor being used as the rotation drive source for the timing rollers. However, no limitation is intended. A DC motor may also be used, for example.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus having a transport device including a pair of timing rollers, operable to cause a leading edge of a recording sheet to abut a nip portion of the pair of timing rollers, which are not rotating, and to initiate rotation so as to transport the recording sheet toward a toner image transfer position, the transport device comprising:

a motor transmitting rotational force to the pair of timing rollers via a power transmission mechanism such that the pair of timing rollers rotate; and a control unit controlling rotation by the motor, wherein the control unit activates the motor, causes the pair of timing rollers to transport a first recording sheet by rotating at a first rotation speed, and stops the motor once transportation is complete, and when a second recording sheet is to be subsequently transported at a second rotation speed that differs from the first rotation speed, the control unit causes the pair of timing rollers to execute an idle rotation operation of rotating at the second rotation speed and then stopping, before beginning transportation of the second recording sheet.

2. The image forming apparatus of claim 1, wherein the first recording sheet is a final recording sheet of a given image formation job, and the second recording sheet is an initial recording sheet of a subsequent image formation job that follows the given image formation job.

3. The image forming apparatus of claim 1, wherein the first recording sheet and the second recording sheet are successive recording sheets of a given image formation job.

4. The image forming apparatus of claim 1, wherein the control unit controls the motor such that a first period lasting from the stopping of the motor in the idle rotation operation to the activation of the motor for beginning transportation of the second recording sheet is equal to a second period lasting, for the second recording sheet and each subsequent recording sheet, from the stopping of the motor upon abutting to the activation of the motor for transport by the pair of timing rollers.

5. An image forming apparatus having a transport device including a pair of timing rollers, operable to cause a leading edge of a recording sheet to abut a nip portion of the pair of timing rollers, which are not rotating, and to initiate rotation so as to transport the recording sheet toward a toner image transfer position, the transport device comprising:

a motor transmitting rotational force to the pair of timing rollers via a power trans mechanism such that the pair of timing rollers rotate; and a control unit controlling rotation by the motor, wherein the control unit activates the motor, causes the pair of timing rollers to transport a first recording sheet by rotating at a first rotation speed, and stops the motor once transportation is complete, and wherein the transport device defines transporting the recording sheet at a second rotation speed that differs from the first rotation speed as a default, and when a final recording sheet of a first image formation job has been transported at the first rotation speed, the control unit causes the pair of timing rollers to execute an idle rotation operation of rotating at the second rotation speed, or at another speed closer to the second rotation speed than to the first rotation speed, and then stopping upon concluding the first image formation job, and when an initial recording sheet of a second image formation job that follows the first image formation job is transported at the second rotation speed, the control unit does not repeat the idle rotation operation before transportation of the initial recording sheet begins.

6. The image forming apparatus of claim 5, wherein the second rotation speed is used for transporting a regular sheet, the first rotation speed is used for transporting a thick sheet, the thick sheet being greater in thickness than the regular sheet, and the first rotation speed is slower than the second rotation speed.

7. An image forming apparatus having a transport device including a pair of timing rollers operable to cause a leading edge of a recording sheet to abut a nip portion of the pair of timing rollers, which are not rotating, and to initiate rotation driving the pair of timing rollers to rotate at a first rotation speed or at a second rotation speed that differs from the first rotation speed, so as to transport the recording sheet toward a toner image transfer position, the transport device comprising:

a motor transmitting rotational force to the pair of timing rollers via a power transmission mechanism such that the pair of timing rollers rotate; and a control unit controlling rotation by the motor, wherein the transport device defines transporting the recording sheet at the second rotation speed as a default, and when a final recording sheet of a given image formation job has been transported at the first rotation speed, upon concluding the first image formation job, the control unit causes the pair of timing rollers to execute an idle rotation operation of rotating at the second rotation speed and then stopping.

8. The image forming apparatus of claim 7, wherein the second rotation speed is used for transporting a regular sheet, the first rotation speed is used for transporting a thick sheet, the thick sheet being greater in thickness than the regular sheet, and the first rotation speed is slower than the second rotation speed.

9. A rotation control method for a motor in an image forming apparatus operable to cause a leading edge of a recording sheet to abut a nip portion of a pair of timing rollers, which are not rotating, and to initiate rotation such that the pair of timing rollers rotate at a first rotation speed, or at a second rotation speed that differs from the first rotation speed, so as to transport the recording sheet toward a toner image transfer position, the motor causing the pair of timing rollers to rotate via a power transmission mechanism, the rotation control method comprising:

a first step of activating the motor such that the pair of timing rollers rotate at the first rotation speed, causing the pair of timing rollers to transport a first recording sheet;

a second step of stopping the motor once transportation of the first recording sheet is complete;

a third step of activating the motor and causing the pair of timing rollers to execute an idle rotation operation at the second rotation speed, and then stopping; and a fourth step of activating the motor such that the pair of timing rollers rotate at the second rotation speed, causing the pair of timing rollers to transport a second recording sheet.

10. The rotation control method of claim 9, wherein the second rotation speed is used for transporting a regular sheet, the first rotation speed is used for transporting a thick sheet, the thick sheet being greater in thickness than the regular sheet, and the first rotation speed is slower than the second rotation speed.

11. The rotation control method of claim 9, wherein the first recording sheet is a final recording sheet of a given image formation job, and the second recording sheet is an initial recording sheet of a subsequent image formation job that follows the given image formation job.

12. The rotation control method of claim 9, wherein the first recording sheet and the second recording sheet are successive recording sheets of a given image formation job.

13. The rotation control method of claim 9, further comprising a repetition step of activating and stopping the motor such that a first period lasting from the stopping of the motor in the idle rotation operation to the activation of the motor for beginning transportation of the second recording sheet is equal to a second period lasting, for each of the second recording sheet and subsequent recording sheets, from the stopping of the motor upon abutting to the activation of the motor for transport by the pair of timing rollers.

14. A rotation control method for a motor in an image forming apparatus operable to cause a leading edge of a recording sheet to abut a nip portion of a pair of timing rollers, which are not rotating, and to initiate rotation such that the pair of timing rollers rotate at a first rotation speed, or at a second rotation speed that differs from the first rotation speed, so as to transport the recording sheet toward a toner image transfer position, the motor causing the pair of timing rollers to rotate via a power transmission mechanism, the rotation control method comprising:

a first step of defining transporting the recording sheet at the second rotation speed;

a second step of activating the rotor such that the pair of timing rollers rotate at the first rotation speed, causing the pair of timing rollers to transport a first recording sheet of a first image formation job;

a third step of stopping the motor once transportation of the first recording sheet is complete, when a final recording sheet of the first image formation job has been transported at the first rotation speed, the rotation control method further comprises a fourth step of: activating the motor and causing the pair of timing rollers to execute an idle rotation operation at the second rotation speed, or at another speed that is closer to the second rotation speed than to the first rotation speed, upon concluding the first image formation job, then stopping the motor, and when an initial recording sheet of a second image formation job that follows the first image formation job is transported at the second rotation speed, the idle rotation operation is not repeated before transportation of the initial recording sheet begins.

15. A rotation control method for a motor in an image forming apparatus operable to cause a leading edge of a recording sheet to abut a nip portion of a pair of timing rollers, which are not rotating, and to initiate rotation such that the pair of timing rollers rotate at a first rotation speed or at a second rotation speed that is a default rotation speed, so as to transport the recording sheet toward a toner image transfer position, the motor causing the pair of timing rollers to rotate via a power transmission mechanism, the rotation control method comprising:

a first step of activating the motor such that the pair of timing rollers rotate at the first rotation speed, causing the pair of timing rollers to transport a final recording sheet of a given image formation job;

a second step of stopping the motor once transportation of the final recording sheet is complete; and a third step of, once the given image formation job is complete, activating the motor and causing the pair of timing rollers to execute an idle rotation at the second rotation speed, then stopping the motor.

16. The rotation control method of claim 15, wherein the second rotation speed is used for transporting a regular sheet, the first rotation speed is used for transporting a thick sheet, the thick sheet being greater in thickness than the regular sheet, and the first rotation speed is slower than the second rotation speed.

* * * * *